US006802763B1

(12) United States Patent
Leung

(10) Patent No.: US 6,802,763 B1
(45) Date of Patent: Oct. 12, 2004

(54) APPARATUS FOR SHARPENING BLADES

(75) Inventor: Rocky Leung, Hong Kong (HK)

(73) Assignees: Salton, Inc., Lake Forest, IL (US); Hop Shing M&P Manufactory Limited, Kwai Chung (HK)

( * ) Notice: Subject to any disclaimer, the term of this patent is extended or adjusted under 35 U.S.C. 154(b) by 27 days.

(21) Appl. No.: 10/280,211

(22) Filed: Oct. 25, 2002

(51) Int. Cl.[7] ..... B24B 3/36

(52) U.S. Cl. ..... 451/267; 451/45; 451/193; 451/293; 76/82; 76/87

(58) Field of Search ..... 451/45, 267, 193, 451/241, 234, 545, 278, 293, 549; 76/82, 87

(56) References Cited

U.S. PATENT DOCUMENTS

| | | | | |
|---|---|---|---|---|
| 822,070 | A | | 5/1906 | McLeran |
| 1,068,973 | A | | 7/1913 | Brown |
| 1,092,877 | A | | 4/1914 | Wallace |
| 1,172,860 | A | | 2/1916 | Aschburner |
| 1,595,322 | A | | 8/1926 | Tanner |
| 2,387,877 | A | | 10/1945 | Broberg |
| 2,431,939 | A | | 12/1947 | Johnson |
| 2,446,909 | A | | 8/1948 | Davis |
| 2,520,279 | A | | 8/1950 | Gallo |
| 2,694,275 | A | | 11/1954 | Lindsay et al. |
| 2,716,846 | A | | 9/1955 | Gerth |
| 2,775,075 | A | | 12/1956 | McMaster et al. |
| 2,787,100 | A | | 4/1957 | Peyches |
| 2,841,926 | A | | 7/1958 | Lebus |
| 2,898,709 | A | | 8/1959 | Bednarski |
| 3,034,264 | A | | 5/1962 | McMaster |
| 3,059,382 | A | | 10/1962 | Lubbock |
| 3,071,899 | A | | 1/1963 | Hicks et al. |
| 3,075,322 | A | | 1/1963 | Uthoff |
| 3,332,173 | A | | 7/1967 | McMaster et al. |
| 3,334,446 | A | | 8/1967 | Jager |
| 3,376,671 | A | | 4/1968 | Wolter |
| 3,583,104 | A | | 6/1971 | Petroske |
| 3,585,717 | A | | 6/1971 | Bielak et al. |
| 3,648,414 | A | | 3/1972 | Thompson |
| 3,719,461 | A | | 3/1973 | Topping |
| 3,808,746 | A | | 5/1974 | Knecht |
| 4,182,972 | A | | 1/1980 | Kaneno et al. |
| 4,265,056 | A | | 5/1981 | Yamamoto |
| 4,333,273 | A | | 6/1982 | Roucau et al. |
| 4,468,894 | A | | 9/1984 | Hong |
| 4,504,283 | A | | 3/1985 | Charvat |
| 4,558,540 | A | | 12/1985 | Collins |
| 4,612,731 | A | | 9/1986 | Eckel |
| 4,627,194 | A | | 12/1986 | Friel |
| 4,672,777 | A | * | 6/1987 | Dunkin ..... 451/282 |
| 4,716,689 | A | | 1/1988 | Friel |
| 4,723,375 | A | | 2/1988 | Linden |
| 4,807,399 | A | | 2/1989 | Friel |
| D303,209 | S | | 9/1989 | Friel |
| 4,897,965 | A | | 2/1990 | Friel |
| 4,915,709 | A | | 4/1990 | Andrew et al. |
| 5,005,319 | A | | 4/1991 | Friel |
| 5,018,310 | A | | 5/1991 | Fierus et al. |
| D326,986 | S | | 6/1992 | Dressel et al. |
| 5,148,634 | A | | 9/1992 | Bigliano et al. |

(List continued on next page.)

*Primary Examiner*—Joseph J. Hail, III
*Assistant Examiner*—Anthony Ojini
(74) *Attorney, Agent, or Firm*—Sonnenschein Nath & Rosenthal LLP

(57) ABSTRACT

A sharpening apparatus with substantially rigid sharpening wheels disposed substantially fixedly on a rotatable drive shaft. An edge of a blade inserted in a slot in the apparatus comes into contact with a sharpening surface on a sharpening wheel. A sliding block associated with that sharpening surface slidably yields to accommodate the inserted blade and applies a force on the blade towards the sharpening surface. The user may selectively adjust force on the blade to achieve more or less sharpening of the edge of the blade. The plurality of sharpening surfaces can offer different levels or degrees of sharpening.

27 Claims, 5 Drawing Sheets

U.S. PATENT DOCUMENTS 5,245,791 A 9/1993 Bigliano et al.
5,283,920 A 2/1994 Plummer
5,397,262 A 3/1995 Lii
5,404,679 A 4/1995 Friel et al.
5,449,315 A 9/1995 Friel
D365,740 S 1/1996 Smith
D372,180 S 7/1996 Powell
5,611,726 A 3/1997 Friel et al.
5,620,359 A * 4/1997 Harrison et al. ..... 451/45
D409,891 S 5/1999 Friel et al.
6,012,971 A * 1/2000 Friel et al. ..... 451/45
6,039,642 A 3/2000 Collins
6,071,181 A 6/2000 Wightman et al.
6,113,476 A 9/2000 Friel, Sr. et al.
6,168,509 B1 1/2001 Presgrove
6,257,967 B1 7/2001 Schultz
6,261,161 B1 7/2001 Yan
6,267,652 B1 7/2001 Friel, Sr. et al.

* cited by examiner

APPARATUS FOR SHARPENING BLADES

The present invention relates to household appliances and, more particularly, to an apparatus for sharpening blades such as knife-blades and the like.

BACKGROUND OF THE INVENTION

Various types of sharpening devices are known in the art for sharpening blades for knives such as common household kitchen knives, hunting knives, fishermens' knives, etc., and blades disposed on ice skates, etc. Many of these known sharpening devices have only one sharpening surface, which limits the quality or type of sharpening that they provide. Usually, different types of sharpening are desirable depending on the particular blade. Using a common household kitchen as an example, knife-blades for tough tasks such as butchery, typically have stronger blades that require a higher degree or level of sharpening to perform these tasks. On the other hand, knife-blades for lighter tasks, such as slicing bread, do not have as strong blades and require a comparatively lower degree or level of sharpening. Other knife-blades, such as those for cutting vegetables and fruit, etc., may need more than one, or a combination of different levels or degrees of sharpening. Such varying types of sharpening needs are not satisfied by knife sharpeners that offer only one type of sharpening surface since a single sharpening surface produces only a single type of sharpened blade. Having a plurality of sharpening surfaces would help facilitate the sharpening of different types of blades, because a plurality of sharpening surfaces can offer a plurality of levels or degrees of sharpened blades.

Some known devices have a plurality of separate sharpening surfaces to offer different levels or degrees of sharpening. These devices, however, usually have drawbacks. For example, the sharpening devices disclosed in U.S. Pat. Nos. 6,267,652, 6,113,476 and 5,611,726 each have a plurality of sharpening surfaces. However, during operation, when a blade is inserted into the sharpening device and against a sharpening surface, such as a wheel having an abrasive surface thereon, the sharpening surface or wheel moves with respect to the blade being sharpened. This is because the force of the blade against the wheel causes the wheel to move away from the blade along the drive-shaft which drives the wheel of the sharpening device. Such movement of the wheel away from the blade causes the force of the sharpening surface of the wheel against the blade to be, at the maximum, the same as the force of the yieldable sharpening surface against the blade.

Further, if additional force is desired between the blade and the sharpening surface of the wheel to achieve more sharpening, such as when the abrasiveness of the sharpening surface has worn with use, the user cannot achieve better sharpening of the blade, at least not with this type of sharpening device. This is because the user cannot apply additional force upon the blade or on the wheel with the abrasive surface to achieve more sharpening of the blade, because the wheel with the abrasive surface simply yields to additional force and moves along the drive shaft. Thus, as stated above, the force of the sharpening surface of the wheel against the blade is, at the most, equal to the force of the yieldable wheel against the blade.

Accordingly, there is a need for an improved sharpening device that offers a plurality of levels or degrees of sharpening, wherein the user may control the sharpening achieved from the sharpening surface of a sharpening device.

SUMMARY OF THE INVENTION

An object of the present invention is to provide a blade sharpening apparatus which has a plurality of levels or degrees of sharpening and which provides control of the sharpening of the blades inserted therein.

Specifically, the sharpening apparatus includes a housing, a rotatable drive shaft disposed in the housing, a driving means associated with the drive shaft to rotate the drive shaft, and a plurality of sharpening wheels substantially fixedly attached to the drive shaft. Each sharpening wheel has a sharpening surface thereon. The abrasiveness of the sharpening surfaces on the sharpening wheels can vary between sharpening surfaces to offer different degrees or levels of sharpening. A sliding block associated with each of the plurality of sharpening surfaces is slidable with respect to the drive shaft. The housing includes a slot corresponding to each of the plurality of sharpening surfaces, with each slot disposed angularly in the housing with respect to the respective sharpening surface.

During operation the sharpening wheels rotate with the drive shaft. A user can insert a blade into a slot corresponding to a sharpening surface on a sharpening wheel with the degree or level of sharpening desired. A sliding block associated with the respective sharpening surface is slidable with respect to the drive shaft. The sliding block slidingly yields when the blade is inserted into the slot for sharpening. The sliding block applies force on the blade towards the sharpening surface to sharpen the blade. The user can adjust the force on the blade against the sharpening surface on the sharpening wheel to increase or decrease the sharpening effect of the sharpening surface upon the blade.

In one embodiment, the apparatus includes a removable magnet underneath the sharpening wheels to attract and trap metal filings and metallic dust, etc., discharged during sharpening operations. The user can selectively remove the removable magnet and appropriately discard the trapped material.

There has thus been outlined, rather broadly, some features consistent with the present invention in order that the detailed description thereof that follows may be better understood, and in order that the present contribution to the art may be better appreciated. There are, of course, additional features consistent with the present invention that will be described below and which will form the subject matter of the claims appended hereto.

In this respect, before explaining at least one embodiment consistent with the present invention in detail, it is to be understood that the invention is not limited in its application to the details of construction and to the arrangements of the components set forth in the following description or illustrated in the drawings. Methods and apparatuses consistent with the present invention are capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the methods and apparatuses consistent with the present invention.

BRIEF DESCRIPTION OF THE DRAWINGS

For a better understanding of the present invention, reference may be made to the accompanying drawings, in which.

DETAILED DESCRIPTION OF THE PREFERRED EMBODIMENTS

Figure 1:
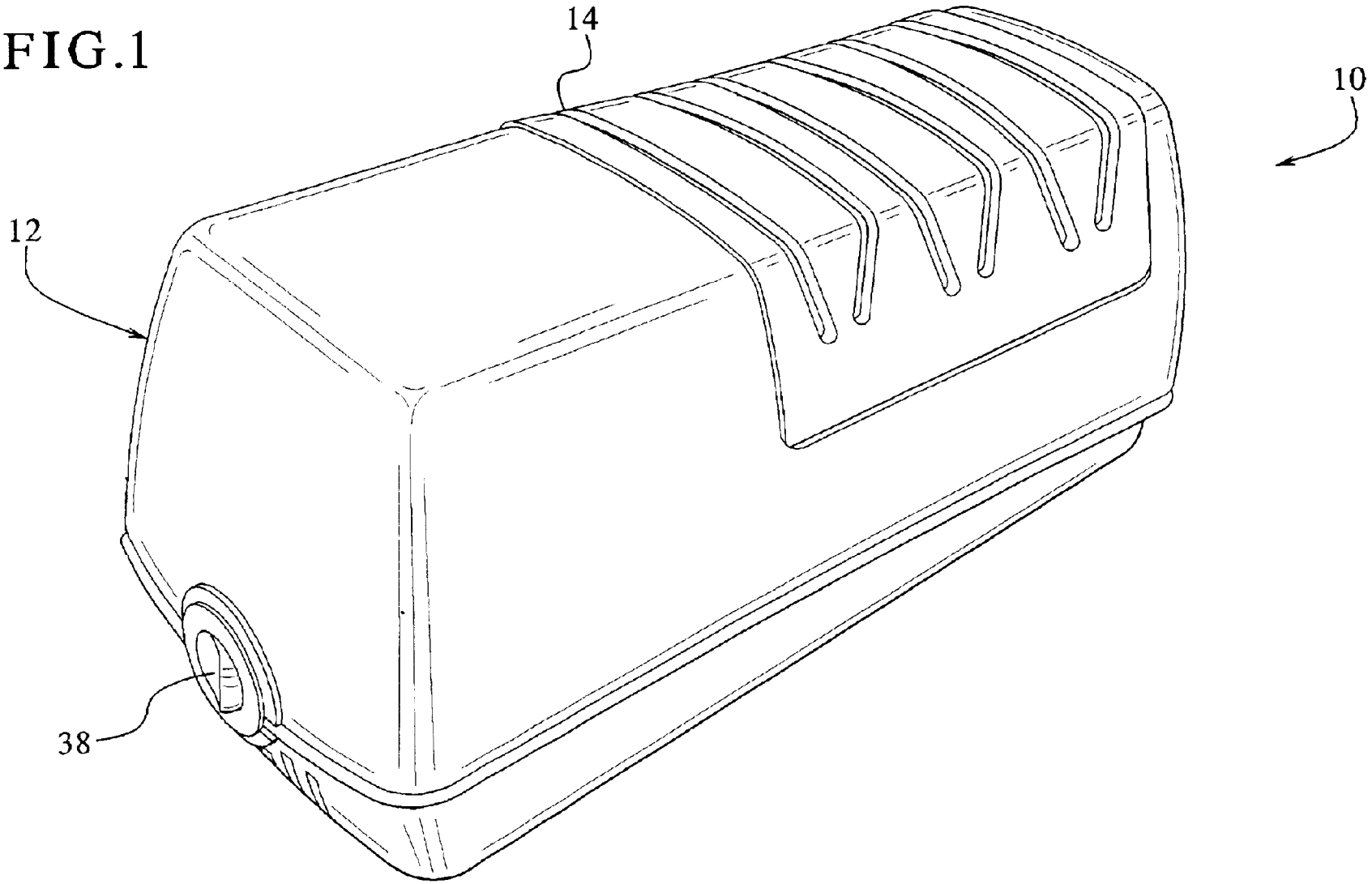
FIG. 1 is a perspective elevational view of a sharpening apparatus according to one embodiment of the present invention.

In the drawings, like numerals refer to like parts across the various figures for more convenient reference.

FIG. 1 is a front elevational view of a sharpening apparatus 10 according to one embodiment of the present invention. Sharpening apparatus 10 includes an exterior housing 12 that houses the internal apparatus. Housing 12 includes a plurality of slots 14 as shown. Slots 14 in one embodiment are disposed substantially in parallel at the top surface of housing 12 as shown in FIG. 1. Slots 14 preferably extend in a direction perpendicular to the longitudinal direction of sharpening apparatus 10, and extend downwards angularly on two side surfaces of housing 12 as shown. When viewed from the side of the housing 12, the slots 14 are not parallel with respect to each other, but can alternate in angle to the left and to the right from the perpendicular, with the angle of each slot 14 on one side of housing 12 being the same as the angle of the slot 14 on the other side of housing 12. In this configuration, a straight blade may be inserted into a slot 14 with the edge to be sharpened pointing downward, with the blade extending through the slot 14 on both sides of housing 12. The slots 14 are guiding means for the blade.

In one embodiment, housing 12 also includes a plurality of feet to support the sharpening apparatus 10 (the feet are hidden from view in the drawings) which are preferably constructed of a slip-resistant material such as rubber, soft plastic, or the like. The feet can be of any shape and size relative to the housing 12, and are implemented to preferably help secure the sharpening apparatus 10 on a surface such as a common kitchen counter-top.

The housing 12 external shape, though rectangular in one embodiment, can also be manufactured in any shape that would still provide the functionality desired from the sharpening apparatus as described below.

Figure 2:
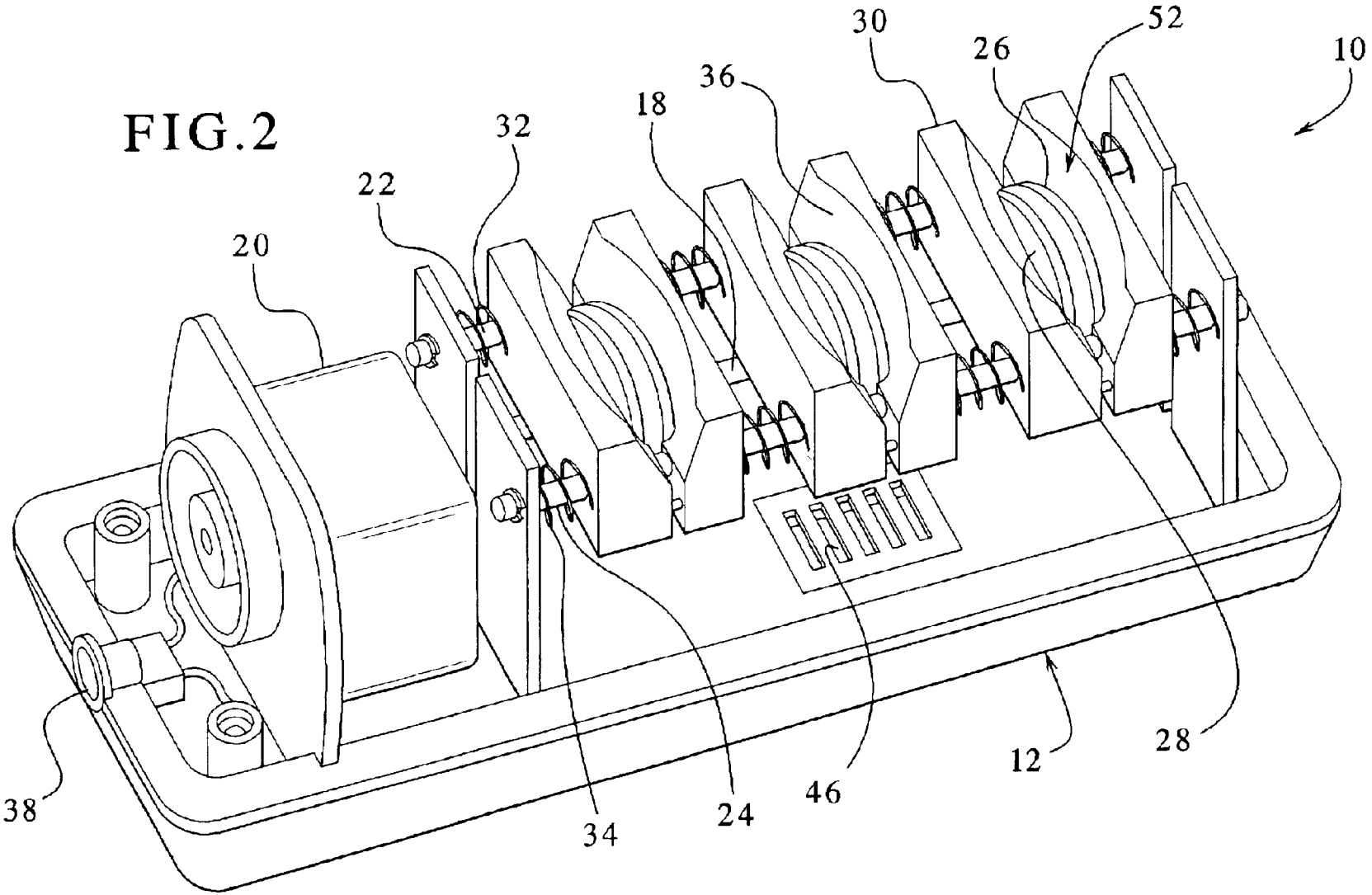
FIG. 2 is a cross-sectional elevational view of the sharpening apparatus of FIG. 1 with a portion of its exterior housing removed.

FIG. 2 is a cross-sectional elevational view of the sharpening apparatus 10 of FIG. 1 with an upper portion of the housing 12 removed. As shown, a central drive shaft 18 is disposed longitudinally in housing 12. Drive shaft 18, as rotating means, is rotatable about its longitudinal axis, and is connected to a driving means operable to rotate it. The driving means may be any means for rotating drive shafts known in the art, such as an electric motor, a manually operable crank, and the like. In one embodiment, the driving means is an electric motor 20.

In the embodiment shown, two slide shafts 22 and 24 are positioned longitudinally and substantially parallel to drive shaft 18 on either side. Slide shafts 22 and 24 and drive shaft 18 have circular cross sections and may be made of a metal in one embodiment, but it is recognized and anticipated that in alternate embodiments they may be of any cross sectional shape and of a different material as long as the described functionality is retained, and without deviating from the spirit and scope of the present invention. It is also recognized and anticipated that alternate embodiments may have just one slide shaft, or even no slide shafts, as long as the described functionality is retained and without departing from the spirit and scope of the present invention.

A plurality of substantially rigid sharpening wheels 26 are substantially fixedly disposed on drive shaft 18. The embodiment shown in FIG. 2 has six sharpening wheels 26, although it is recognized and anticipated that alternate embodiments may have more sharpening wheels 26 or less sharpening wheels 26, which will typically depend on the intended use of the respective sharpening apparatus 10. Each sharpening wheel 26 has a sharpening surface 28 on one (outer) side surface of the wheel 26. Sharpening surface 28 may be an abrasive surface formed integrally on the side surface of sharpening wheel 26, an abrasive material implemented on the side surface of sharpening wheel 26, or a relatively strong resin with abrasive material such as grit, or the like, disposed on the wheel's side surface. Various methods and apparatuses for forming and implementing abrasive surfaces on sharpening surfaces is known in the art. Further, the level or degree of abrasiveness of sharpening surface 28 may be different for the various sharpening wheels 26. It is recognized and anticipated that the level or degree of abrasiveness of the sharpening means, which includes the sharpening surfaces 28 on the respective sharpening wheels 26 will vary from one embodiment to another, and will likely be customized in accordance with the blades that the particular sharpening surface 28 is designed to sharpen.

Figure 3:
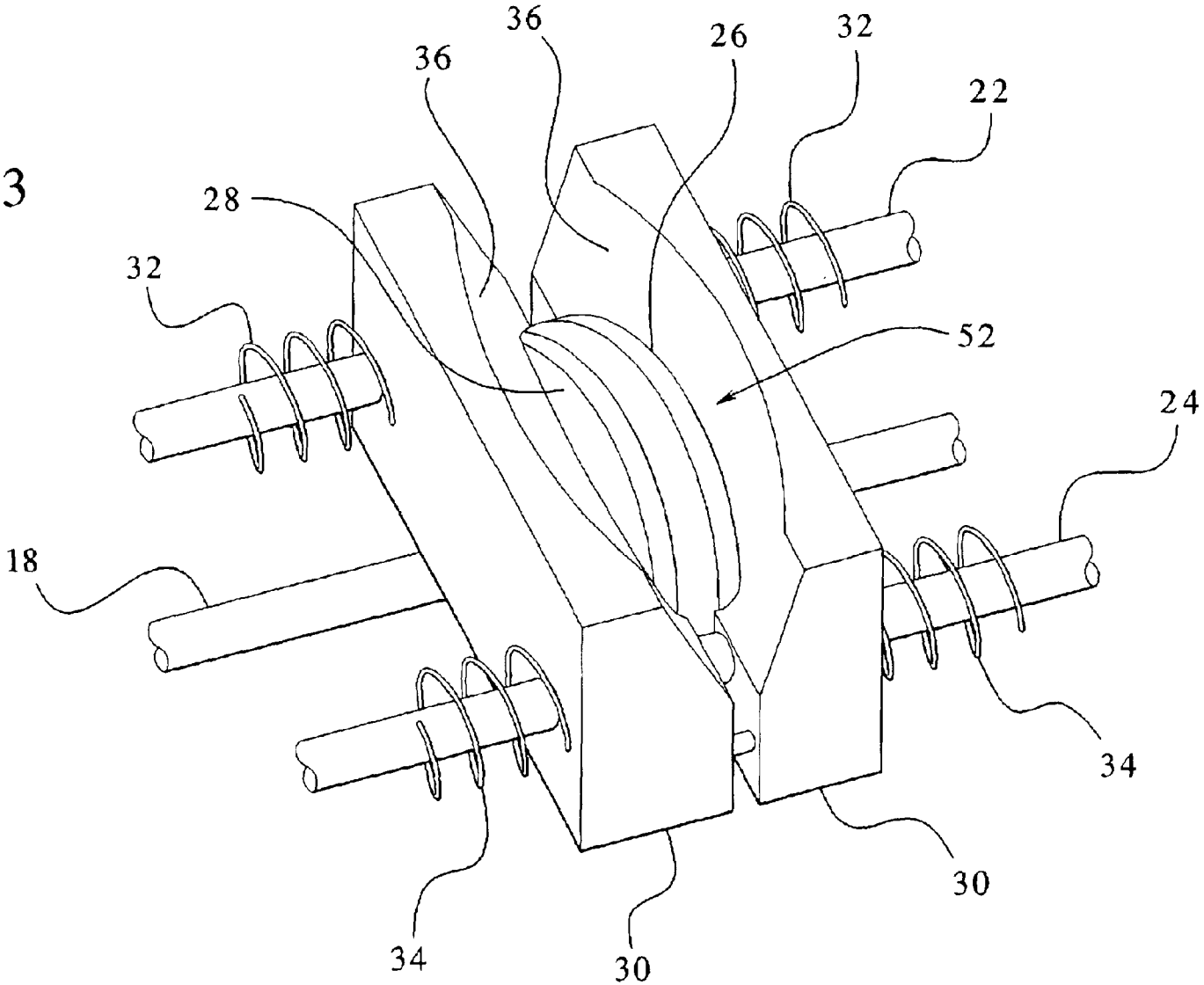
FIG. 3 is a perspective elevational view of the apparatus showing the sharpening apparatus of FIGS. 1 and 2 in more detail, which corresponds to one stage of sharpening.

Corresponding to each sharpening surface 28 is a sliding block 30 slidably disposed on sliding shafts 22 and 24. In the embodiment shown in FIG. 2, there are six sliding blocks 30, divided into pairs which are disposed on either side of each of the pairs of sharpening wheels 26. Each sliding block 30 faces a sharpening surface 28 of each the six sharpening wheels 26. Each sharpening block 30 is biased toward its corresponding sharpening wheel 26 as shown by springs 32 and 34, as biasing means. In the embodiment shown in FIGS. 2–3, springs 32 and 34 are disposed respectively on sliding shafts 22 and 24. Accordingly, each sliding block 30 is slidable with respect to drive shaft 18 and sliding shafts 22 and 24 against the biasing force of its corresponding springs 32 and 34. Each sliding block 30 has a sloping surface 36 towards the sharpening surface 28 of its corresponding sharpening wheel 26 as shown in FIG. 3. A gap 52 is formed between each sharpening surface 28 of the sharpening wheel 26 and the sloping surface 36 on the corresponding sliding block 30. As described in more detail below, a blade can be inserted in this gap 52 for sharpening.

Those skilled in the art will appreciate that the two sliding shafts 22 and 24, can be replaced with just one sliding shaft for the sliding blocks 30 to slide on. In other embodiments, slide shafts 22 and 24 can be eliminated altogether and sliding blocks 30 can be slidably disposed on drive shaft 18.

Each slot 14 in housing 12 corresponds to a sharpening surface 28. The angular slope of each slot 14 in the side surfaces of housing 12 (better shown in FIG. 1) corresponds with the slope 36 of a sliding block 30 which is adjacent a sharpening surface 28 of each sharpening wheel 26. A blade inserted into a slot 14 will follow the angle of the respective slot 14 and slope 36 into gap 52 between the sliding block 30 and sharpening surface 28 (see FIG. 5). As the blade follows slope 36, the edge of the blade will be guided towards the sharpening surface 28 of the corresponding sharpening wheel 26. To accommodate the thickness of the blade between the slope 36 of sliding block 30 and sharpening surface 28 of the sharpening wheel 26, sliding block 30 will yield to the blade thickness, by compressing springs 32, 34 and moving away from the sharpening wheel 26 by sliding on sliding shafts 22 and 24. When inserted, the edge of the blade will come into contact with sharpening surface 28 at an angle. As drive shaft 18 rotates when apparatus 10 is operated, sharpening wheels 26 rotate therewith and the edge of the blade is sharpened by the abrasive action of the moving sharpening surface 28 against the edge of the blade.

During operation of the sharpening apparatus 10, the biasing force of springs 32 and 34 will push the sliding block 30 against the blade, and the edge of the blade will be pushed against the sharpening surface 28 to increase the effectiveness of the sharpening process. Although the sliding blocks 30 yield when the blade is inserted due to the compression of the springs 32, 34 (see FIG. 5), the sharpening wheels 26 remain substantially fixed. Therefore, if the user desires an increased sharpening effect on the blade, the user can apply force on the blade to push the edge of the blade more forcibly against the sharpening surface 28, and the compressive or biasing force of the springs 32, 34 will not allow slackening of the block 30 away from the sharpening surface 28. Vice versa, if the user desires lesser sharpening, the user can apply less force on the blade, to decrease the amount of force applied to the blade edge against the sharpening surface 28. Thus, the amount of force of the blade's edge against the sharpening surface 28 can be adjusted and applied selectively, as desired by the user. The sharpening effect of the sharpening apparatus 10 is therefore, not limited to the amount of force exerted by the springs 32, 34 on the corresponding sliding block 30, but is in part, achieved by the force applied on the blade by the user.

FIG. 3 is a perspective elevational view of the apparatus showing the sharpening apparatus of FIGS. 1 and 2 in more detail. As shown, two sharpening wheels 26 are disposed side-by-side and substantially rigidly attached to drive shaft 18, with a sharpening surface 28 respectively disposed on each sharpening wheel 26. Sliding blocks 30 which correspond to sharpening surfaces 28 are slidably disposed on sliding shafts 22 and 24. The sharpening surface of each sharpening wheel 26 is disposed on an outer side surface of the sharpening wheel 26, opposed to the corresponding sliding block 30.

Preferably, the sharpening surfaces 28 on both outer side surfaces of the sharpening wheels 26 provide the same level or degree of sharpening so that the pair of sharpening wheels 26 together form one stage of sharpening, however, the degrees or levels of sharpening may vary. Thus, a user may achieve the same level or degree of sharpening for both sides of a blade by inserting the blade in each of the two slots 14 corresponding to the two sharpening surfaces 28 in that one stage of sharpening.

The embodiment shown in FIG. 2 has three stages of sharpening, with two sharpening wheels 26 in each stage. In one embodiment, the three stages correspond to rough, normal and fine levels or degrees of sharpening. It is recognized and anticipated, however, that in alternate embodiments, the number of stages and the levels or degrees of sharpening offered by each stage can be varied as desirable for the particular embodiment without departing from the spirit and scope of the present invention. The sharpening surfaces 28 which correspond to rough, normal, and fine, vary in abrasiveness to provide the differing levels of sharpening. The level or degree of abrasiveness can be achieved by using differing types of surfaces known in the art, for the differing stages of sharpening.

Figure 4:
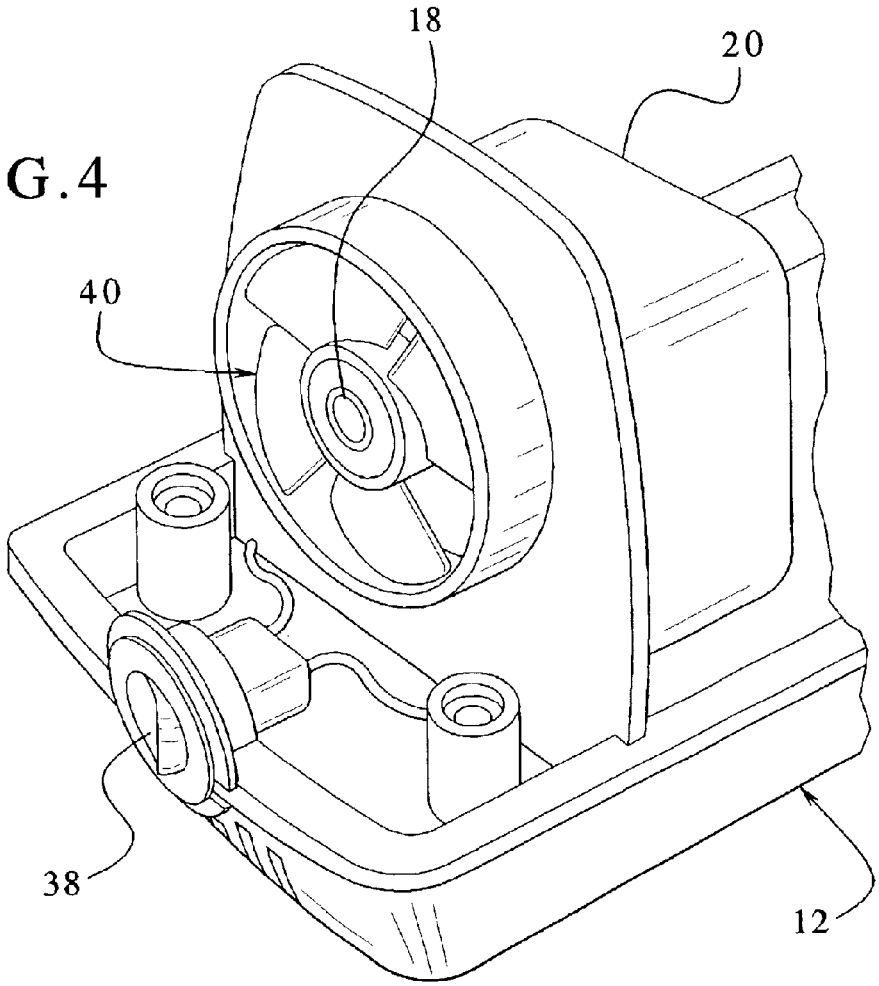
FIG. 4 is a perspective elevational view of a portion of the sharpening apparatus of FIGS. 1 and 2.

FIG. 4 is a perspective elevational view of a portion of the sharpening apparatus of FIGS. 1 and 2. In this embodiment, the apparatus 10 includes a switch 38 which is electrically connected to an electric motor 20. The switch 38 is accessible from the exterior of housing 12. Switch 38 is selectively operable for operating motor 20 to rotate drive shaft 18, thus, selectively operating the sharpening apparatus 10. In one embodiment, switch 38 is an ordinary on/off switch. In an alternate embodiment, switch 38 is a variable speed switch operable to selectively control the speed of the electric motor 20.

In one embodiment, the sharpening apparatus 10 also includes a fan 40 connected to drive shaft 18 as shown in FIG. 4. The fan 40 rotates with the drive shaft 18 during operation, thereby generating airflow through the apparatus 10 during operation. This may facilitate cooling of the electric motor 20, cooling of the abrasive surfaces 28 during the sharpening operation, and blowing off of the filings and dust discharged from the blade and the sharpening surface 28 during a sharpening operation.

Figure 5:
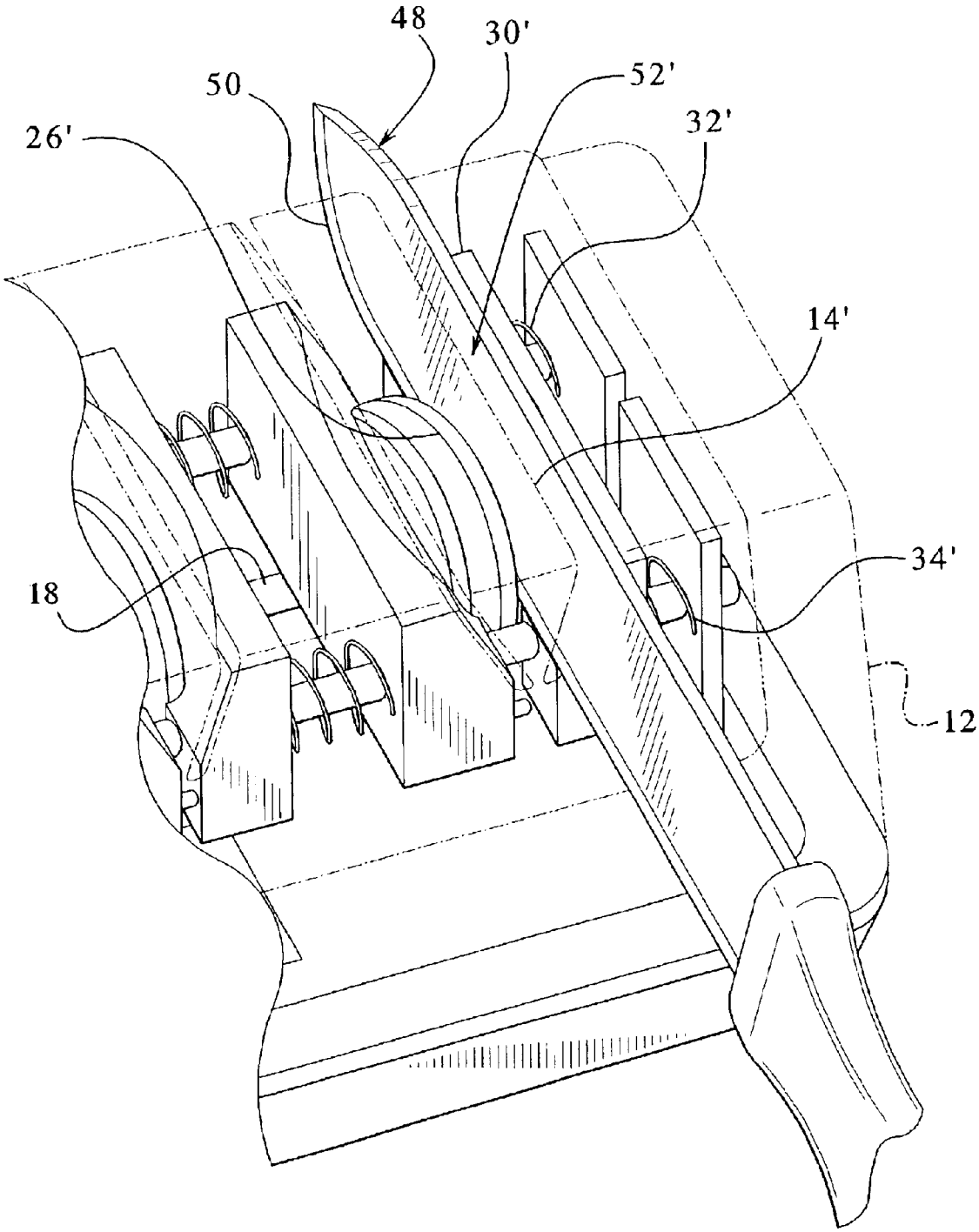
FIG. 5 is a perspective view of a portion of the sharpening apparatus of FIGS. 1 and 2 with the exterior housing shown in phantom outline form and a blade inserted in the apparatus for a sharpening operation.

FIG. 5 is a perspective view of a portion of the sharpening apparatus of FIGS. 1 and 2 with the exterior housing 12 shown in phantom outline form and a blade 48 inserted in the sharpening apparatus 10 for a sharpening operation. Blade 48 can be inserted in any slot 14'. As the blade 48 is lowered into slot 14', an edge 50 of blade 48 is guided by slot 14', which extends angularly into the side surfaces of housing 12 as shown. Blade 48 thus enters gap 52' between the corresponding sharpening surface (hidden from view in FIG. 5) on a sharpening wheel 26' and a corresponding sliding block 30'. The slope (hidden from view in FIG. 5 by blade 48) on sliding block 30' guides edge 50 of blade 48 towards the sharpening surface (hidden from view) on sharpening wheel 26'. The user may thus continue inserting blade 48 in slot 14' until edge 50 of blade 48 comes in contact at an angle with the sharpening surface on sharpening wheel 26'. The contact between edge 50 of blade 48 and the sharpening surface is facilitated by the force of compressed springs 32' and 34', which are implemented about sliding shafts 22 and 24 respectively, on sliding block 30'. During operation, as drive shaft 18 rotatably drives sharpening wheel 26', the edge 50 of blade 48 is held against the rotating sharpening surface at an angle with respect thereto, to sharpen edge 50. The user may effectively increase or decrease the sharpening effect by increasing or decreasing the amount of force between edge 50 and the sharpening surface by manually adjusting the amount of force on blade 48 with respect to the sharpening surface on sharpening wheel 26'.

Figure 6:
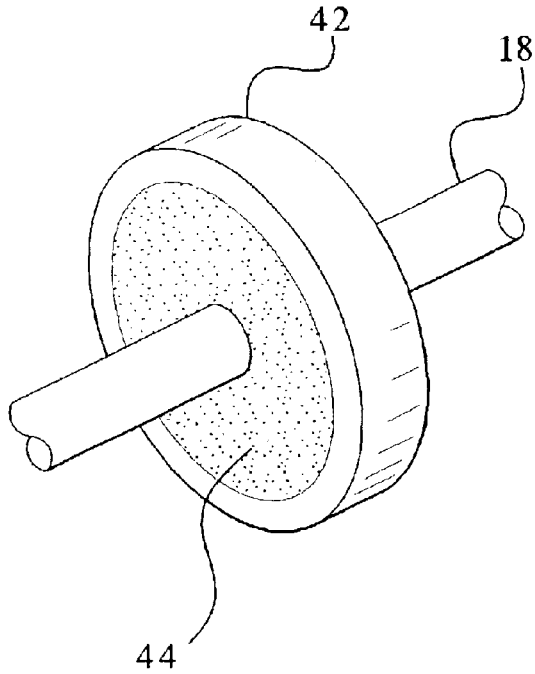
FIG. 6 is a perspective elevational view of an alternate embodiment of a sharpening wheel in the sharpening apparatus of FIG. 1.

FIG. 6 is a perspective elevational view of an alternate embodiment of a sharpening wheel in the sharpening apparatus of FIG. 1. In the embodiment shown, two sharpening wheels 26 in one stage of FIG. 1, are replaced with one substantially rigid sharpening wheel 42 with a sharpening surface 44 on each side thereof. Sharpening wheel 42 is substantially fixedly disposed on drive shaft 18. This embodiment may be preferable, for example, for implementing a sharpening surface with a relatively finer level or degree of sharpening. In this regard, it is recognized and anticipated that the sharpening wheels in device 10 may either be all of the embodiment shown in FIG. 2 or of the embodiment shown in FIG. 5, or they may be any desired combination of the two.

In one embodiment, the sharpening apparatus lo also includes a magnet 46 (best shown in FIG. 2) implemented underneath the sharpening wheels for attracting and trapping metal filings, metallic dust, etc., generated during blade sharpening operations. Magnet 46 is preferably removable so the user can selectively remove it and appropriately discard the trapped material. In one embodiment, magnet 46 is implemented in a removable compartment disposed in housing 12. The compartment preferably includes openings so that the magnet is at least partially exposed to the sharpening wheels 26 so that extraneous material falling from the sharpening wheels and the blade during operation can be attracted and trapped by magnet 46 inside the compartment. This removable compartment can be implemented in housing 12 in any of various ways known in the art, such as a hinged door, a snap-on/snap-off piece, and the like.

It is recognized that variations to the construction and design of the present sharpening apparatus can be made without departing from the spirit and scope of the present invention. In this regard, particular features could be added or particular features could be eliminated. Additionally, as is evident from the foregoing description, certain aspects of the present invention are not limited by the particular details of the examples illustrated herein, and it is therefore contemplated that still other modifications and applications, or equivalents thereof, will occur to those skilled in the art. It is accordingly intended that the claims shall cover all such modifications and applications that do not depart from the spirit and scope of the present invention.

Other aspects, objects and advantages of the present invention can be obtained from a study of the drawings, the disclosure, and the claims.

What is claimed is:

1. A sharpening apparatus, comprising:

a housing including a plurality of slots disposed in said housing in parallel formation on a top surface of said housing, and disposed at an angle with respect to one another at a side surface of said housing;

a rotatable drive shaft disposed in said housing;

a driving means associated with said drive shaft to rotate said drive shaft;

a plurality of sharpening wheels substantially fixedly attached to said drive shaft, each sharpening wheel having a sharpening surface thereon; and a sliding block biased against a corresponding sharpening wheel and said respective sharpening surface;

wherein each of said plurality of slots corresponds to each said sharpening surface;

wherein when a blade is inserted into one of said plurality of slots, said sliding block yields slidingly along said drive shaft;

wherein at least one slide shaft disposed in parallel with said drive shaft; and wherein each said sliding block is slidably disposed on said at least one slide shaft.

2. The sharpening apparatus of claim 1, further comprising:

a magnet removably disposed in a compartment underneath said plurality of sharpening wheels;

wherein said magnet attracts metallic material discharged from said blade during a sharpening operation.

3. The sharpening apparatus of claim 2, wherein said compartment contains apertures which expose said magnet to said plurality of sharpening wheels.

4. The sharpening apparatus of claim 1, wherein at least two sharpening wheels of said plurality of sharpening wheels have substantially identical abrasive sharpening surfaces and said at least two sharpening wheels form one stage of sharpening.

5. The sharpening apparatus of claim 4, wherein said plurality of sharpening wheels are six in number, and said six sharpening wheels form three stages of sharpening consisting of two sharpening wheels in each of said three stages.

6. The sharpening apparatus of claim 5, wherein each stage provides a different level of sharpening.

7. The sharpening apparatus of claim 1, wherein said sharpening surface of at least two of said plurality of sharpening wheels provides a different level of sharpening from one other.

8. The sharpening apparatus of claim 1, wherein said driving means is an electric motor.

9. The sharpening apparatus of claim 8, and further comprising:

a switch electrically connected to said electric motor and operable to selectively rotate said drive shaft.

10. The sharpening apparatus of claim 1, wherein said sliding block is biased by a force of a spring disposed on said slide shaft, and said sliding block is slidable to compress said spring when said blade is inserted in said one of said plurality of slots.

11. The sharpening apparatus of claim 1, wherein the at least one slide shaft includes:

two slide shafts disposed in parallel with said drive shaft;

wherein each said sliding block is slidably disposed on said two slide shafts, and a spring disposed on each of said two slide shafts for biasing each said sliding block; and wherein said sliding blocks are slidable against a biasing force of said springs.

12. The sharpening apparatus of claim 1, further comprising a fan implemented on said drive shaft such that said fan rotates with said drive shaft and creates airflow in said housing during a sharpening operation.

13. The sharpening apparatus of claim 1, wherein each said sliding block includes a slope at a side surface thereof, said slope which guides an edge of a blade inserted into said corresponding one of said plurality of slots, towards said corresponding sharpening surface on said respective one of said plurality of sharpening wheels.

14. The sharpening apparatus of claim 1, wherein said plurality of sharpening wheels comprise at least one pair of sharpening wheels disposed side-by-side, and said corresponding sharpening surface of each of said pair of sharpening wheels is at an outer side surface thereof.

15. The sharpening apparatus of claim 1, wherein each of said plurality of sharpening wheels has a sharpening surface on both side surfaces of each of said sharpening wheels.

16. The sharpening apparatus of claim 1, wherein at least one of said plurality of sharpening wheels has a sharpening surface on both side surfaces of said at least one of said plurality of sharpening wheels.

17. A sharpening apparatus for sharpening blades, comprising:

an exterior housing having a plurality of slots disposed in parallel formation on a top surface thereof and extending at an angle with respect to one another at two side surfaces thereof;

a rotatable drive shaft disposed in said housing, said rotatable drive shaft positioned longitudinally in said housing;

an electric motor operably connected to said rotatable drive shaft, said electric motor operable to rotate said drive shaft;

a plurality of substantially rigid sharpening wheels disposed substantially fixedly on said rotatable drive shaft, each sharpening wheel having at least one sharpening surface thereon;

at least one slide shaft disposed in said housing substantially parallel to said rotatable drive shaft; and a plurality of sliding blocks slidably disposed on said at least one slide shaft, each sliding block biased against and corresponding to said at least one sharpening surface of one of said plurality of sharpening wheels;

wherein each of said plurality of sliding blocks has a sloping side surface which corresponds to said angle of one of said plurality of slots;

wherein an edge of a blade inserted in said one of said plurality of slots in said housing is guided towards said corresponding sharpening surface by said sloping side surface of said one of said plurality of sliding blocks; and wherein said one of said sharpening wheels corresponding to said sharpening surface remains substantially rigid while said corresponding one of said sliding blocks yields slidingly to accommodate said edge of said blade therebetween.

18. The sharpening apparatus of claim 17, wherein said sliding blocks are biased in position against said corresponding sharpening surface of said one of said sharpening wheels by a spring disposed on said at least one slide shaft.

19. The sharpening apparatus of claim 17, further comprising:

a magnet removably disposed in a compartment underneath said plurality of sharpening wheels;

wherein said magnet attracts metallic material discharged from said blade during a sharpening operation.

20. The sharpening apparatus of claim 17, further comprising:

a switch connected to said electric motor for selectively operating said electric motor to rotate said drive shaft.

21. The sharpening apparatus of claim 17, wherein said plurality of sharpening wheels are six in number, and said six sharpening wheels form three stages comprised of two sharpening wheels each, each of said two sharpening wheels in each of said three stages having at least one sharpening surface; and wherein in each of said three stages, said at least one sharpening surface of each of said two sharpening wheels has substantially the same level of sharpening.

22. The sharpening apparatus of claim 17, wherein said plurality of sharpening wheels comprise at least one pair of sharpening wheels disposed side-by-side, and said corresponding sharpening surface of each of said pair of sharpening wheels is at an outer side surface thereof.

23. The sharpening apparatus of claim 17, wherein each of said plurality of sharpening wheels has a sharpening surface on both side surfaces of each of said sharpening wheels.

24. The sharpening apparatus of claim 23, wherein each said sharpening surface on said both side surfaces of each of said sharpening wheels provides substantially the same level of sharpening.

25. The sharpening apparatus of claim 17, further comprising:

a fan implemented on said drive shaft such that said fan rotates with said drive shaft and creates airflow in said housing during a sharpening operation.

26. The sharpening apparatus of claim 17, wherein at least one of said plurality of sharpening wheels has a sharpening surface on both side surfaces of said at least one of said plurality of sharpening wheels.

27. A sharpening apparatus for sharpening blades, comprising:

a housing;

guiding means for guiding a blade inserted into said housing;

sharpening means disposed within said housing for sharpening said blade when said blade is inserted in said guiding means;

rotating means for rotating said sharpening means such that said sharpening means sharpens said blade;

driving means for driving said rotating means;

at least one slide shaft disposed in said housing substantially parallel to said rotating means; and a plurality of sliding blocks slidably disposed on said at least one slide shaft;

biasing means for biasing each of said sliding blocks against said sharpening means;

wherein when said blade is inserted into said guiding means, said guiding means guides said blade to said sharpening means; and wherein when said blade comes into contact with said sharpening means, said sharpening means remains substantially rigid while said corresponding one of said sliding blocks yields slidingly on said slide shaft to accommodate said blade therebetween.

* * * * *